United States Patent [19]

Trentini et al.

[11] 4,155,398

[45] May 22, 1979

[54] METHOD AND APPARATUS FOR CONTINUOUS CENTRIFUGAL CASTING OF METAL PRODUCTS

[75] Inventors: Bernard Trentini, St.-Germain-en-Laye; Robert Alberny; Jean-Pierre Birat, both of Metz, all of France

[73] Assignee: Institut de Recherches de la Siderurgie Francaise, St.-Germain-en-Laye, France

[21] Appl. No.: 906,645

[22] Filed: May 16, 1978

[30] Foreign Application Priority Data

May 18, 1977 [FR] France ..... 77 15831

[51] Int. Cl.[2] ..... B22D 27/02; B22D 11/12

[52] U.S. Cl. ..... 164/49; 164/147; 164/82

[58] Field of Search ..... 164/48, 49, 82, 84, 164/422, 146, 147, 418, 83

[56] References Cited

U.S. PATENT DOCUMENTS

| | | | |
|---|---|---|---|
| 3,464,812 | 9/1969 | Utech et al. | 164/49 |
| 3,842,895 | 10/1974 | Mehrabian et al. | 164/82 |
| 3,905,417 | 9/1975 | Delassus | 164/147 |
| 4,026,346 | 5/1977 | Birat et al. | 164/147 |

*Primary Examiner*—Othell M. Simpson
*Assistant Examiner*—K. Y. Lin
*Attorney, Agent, or Firm*—Michael J. Striker

[57] ABSTRACT

A method of continuous centrifugal casting of metal products in which molten metal is rotated during the passage through an elongated cooled ingot mold about the axis of the latter and in which the still liquid core of the partly solidified casting as it leaves the ingot mold is subjected to forces counteracting the rotation of the still liquid core of the casting.

15 Claims, 7 Drawing Figures

METHOD AND APPARATUS FOR CONTINUOUS CENTRIFUGAL CASTING OF METAL PRODUCTS

BACKGROUND OF THE INVENTION

The present invention relates to continuous centrifugal casting of metal strands, especially steel.

As it is known, a method of continuous casting of metal, especially steel, in which the liquid metal in the ingot mold is rotated about the axis of the latter, provides, as compared with a continuous casting method in which the liquid metal is not rotated, a considerable improvement as far as the quality of the resulting product is concerned, especially with regard to the cleanliness of the outer skin as well as the inner structure of the casting. The cleanliness of the outer skin is shown, on the one hand, by a surface free of incrustations of slag due to the gathering of such slag at the center of the free surface of the metal in the ingot mold which, under the effect of the rotational movement will assume a concave shape, from the center of which the concentrated slag may easily be removed, and, on the other hand, by the reduction in the first few centimeters of the solidified metal of the number of non-metallic inclusions resulting from the transfer of the latter toward the axis of the cast product. The improvement of the internal structure is characterized especially by the reduction of its central porosity and by suppression of axial macrosegregations, which results are obtained due to the formation of a large equiaxed zone of solidification to the prejudice of a peripheral zone of solidification of the basaltic type which is correspondingly reduced.

Two methods of continuous centrifugal casting of metals are known, that is the continuous centrifugal casting of metal by mechanical means and the continuous centrifugal casting of metal by electromagnet means. These two methods differ from each other mainly by the means utilized in order to rotate the liquid metal in the ingot mold. In the first-mentioned method the centrifugal action is obtained by mechanically rotating the assembly of elements forming the ingot mold itself, whereas in the second method the centrifugal action is obtained by the action of a magnetic field which turns about the axis of the mold and which is usually produced by a stationary multiphase inductor located in the water jacket surrounding the ingot mold. From a technological point of view, the process in which electromagnet means are used for rotating the liquid metal in the ingot mold is preferably to the other method in that it can be carried out by simpler means, due to the absence of any movable mechanical member to assure the rotation of the liquid metal, and furthermore this method may also be used for continuous casting of curved metal strands and for the production of metallic strands of various cross-sections, that is not only round, but also square or similar non-round cross-section. As far as the finished product is concerned, it can be said that, at the present state of development of the two methods, the products respectively obtained from the same are of very similar quality. The two methods have, however, a common disadvantage due to the concentration of non-metallic inclusions in the axial zone of the cast product. These shortcomings of the finished products can be observed after rolling of the products and in particular these internal faults are observed in the interior of the steel tubes obtained during continuous centrifugal casting of the same.

SUMMARY OF THE INVENTION

It is an object of the present invention to overcome such common shortcomings of metal castings produced by centrifugal continuous casting of liquid metal.

With these and other objects in view, which will become apparent as the description proceeds, the method according to the present invention of continuous centrifugal casting of metal products mainly comprises the steps of continuously passing liquid metal through an elongated cooled ignot mold so that the metal partly solidifies as it leaves the mold, rotating the liquid metal during such passage through the mold about the axis of the latter, subjecting the still liquid core of the partly solidified casting as it leaves the ingot mold to forces counteracting the rotation of the still liquid core in the interior of the casting, and continuously withdrawing the casting in a predetermined direction.

According to one way of carrying out the invention, the counteracting forces are produced by a magnetic field which traverses the cooled product in a direction normal to the axis of the casting.

According to one modification the magnetic field is stationary. According to another modification the magnetic field is a field which turns about the casting in a direction opposite to the direction of the rotation of the liquid metal in the ingot mold.

According to another way of carrying out the method, the counteracting forces are produced by a magnetic field the direction of which at the axis of the casting blends with the direction of this axis. According to a specific variation of this method the magnetic field is a field moving in the direction of the axis of the cast product and preferably in the direction of extraction of the casting of the mold.

According to a preferred way of carrying out the method, the counteracting forces are arranged to act on the cooled product as it leaves the ingot mold after the start of solidification of the outer annular portion of the casting.

According to another modification in which the counteracting forces are produced by mechanical means, these mechanical means are arranged to act on the casting before formation at the center of the casting of a zone sufficiently viscous to rotate together with the already solidified outer part of the casting.

A further object of the present invention is to provide an apparatus for continuous centrifugally casting of metal which comprises an elongated cooled ingot mold, means for continuously feeding molten metal into the cooled ingot mold, means for rotating the liquid metal in the ingot mold about the axis of the latter, and means arranged downstream of the ingot mold for subjecting the still liquid core of the partly solidified casting leaving the ingot mold to forces opposing rotation of the still liquid metal core. According to one embodiment of the apparatus, the means disposed beneath the ingot mold are constituted by at least one electromagnet producing a stationary magnetic field normal to the axis of the casting through which the casting passes.

According to another modification, the rotation opposing means are constituted by a tubular stationary inductor surrounding the casting and supplied by a multiphase electric current to produce a magnetic field normal to the axis of the casting and turning about this axis.

According to another modification, the rotation opposing means are constituted by a solenoid surrounding the casting.

According to a preferred modification, the rotation counteracting means are constituted by stationary tubular inductor surrounding the casting and composed of a stack of coaxial spools connected to a multiphase electric current in such a manner so as to create a mobile magnetic field moving in the direction of the axis of the casting.

The essential characteristic of the invention is to reduce, even to completely suppress rotation of the liquid core of the casting as the latter leaves the ingot mold. The end result is not to diminish the total amount of inclusions, but to avoid a too heavy concentration thereof in an axial zone of the casting by distributing such inclusions throughout the volume of the still liquid metal. This object results from the following considerations: The gathering of the inclusions in the center of the casting is due to a backflowing process of these inclusions, which is a direct consequence of the rotational movement about the axis obtained by the cast liquid metal at its introduction into the ingot mold and which is continued downstream of the latter. This consideration is based on the fact that during continuous centrifugal casting by mechanical means the rotational movement of the liquid metal below the ingot mold is maintained by turning the whole cast product about its axis. During continuous centrifugal casting by electromagnet means, on the other hand, only the liquid metal present in the ingot mold is directly subjected to a centrifugal action. Nevertheless, it will be obvious that the centrifugal action in the ingot mold will likewise be perpetuated below the same. The existence of the secondary centrifugal action, below the ingot mold, is demonstrated by the fact that the structure of solidification of the cast product is identical to that obtained by the known electromagnetic rotary mixing in the secondary cooling zone of a continuous casting apparatus (French Pat. No. 2,236,584 and French Pat. No. 2,211,305). It will therefore be understood that any action on the liquid metal which tends to interfere with its rotary movement below the ingot mold leads to a better homogenization of the central part of the cast product, which has the effect to disperse the non-metallic inclusions throughout the cross-section of the liquid metal at the place where this antagonistic action takes place. It will be likewise understood that in this respect the dispersion of the inclusions will be the more effective, the greater the available volume of the liquid metal is. It will therefore be clear that the antagonistic action will be the most effective if it is located as close as possible downstream of the ingot mold, that means immediately below the latter. It will however be seen from the following that for other reasons it may be advantageous to act on the liquid metal farther below.

This antagonistic action with the aim to suppress or at least considerably brake the rotary movement of the liquid metal below the ingot mold constitute the generally characteristic feature of the present invention. This action may be realized in practice by various particular solutions known per se from the mechanical mixing or bubbling up of gas, etc. The inventors nevertheless recommend utilization of electromagnetic means which have various advantages, such as the simplicity of installing the same and its adaption to an existing apparatus for continuous casting of metal. The only necessary condition to carry out the method of the present invention is that the direction of the magnetic field should not be parallel to the direction of relative displacement between the magnetic field and the flow of the still liquid metal of the casting. This phenomena originates during continuous centrifugal casting by electromagnet means by rotating the liquid metal in the ingot mold for continuous casting by means of a magnetic field which traverses the metal normal to the axis of the casting and turning about this axis. Within the framework of the present invention the inventors use this phenomena in a novel manner not to rotate the liquid metal, but, to the contrary, of braking this rotation, or expressed more generally, to counteract the existing rotational movement. The characteristics of the magnetic field may be numerous and varying provided that it respects the only condition mentioned above, that the magnetic field is not parallel to the direction of the relative displacement between itself and the flow of the still liquid metal of the casting. The magnetic field may thus traverse the product in a direction normal to the axis of the casting, in a direction parallel to this axis, or, more generally, along a direction which has a component greater than zero in a radial plane passing through the axis of the casting. On the other hand, the magnetic field must not necessarily be mobile since the relative displacement between the field and the cast product is automatically assured by the rotational movement of the liquid metal which it obtains in the ingot mold. Therefore the magnetic field may be stationary. In this case it may be an alternating or a continuous field. The inventors nevertheless recommend the second solution since it permits to avoid, on the one hand, undesired vibrations of the liquid metal, and, on the other hand, a non-desirable increase in the reacting force on the electric supply network.

It should be noted that the use of a mobile magnetic field, for example turning about the axis of the casting in a sense opposing the existing rotation of the liquid metal, contributes to the relative displacement between the field and the liquid metal, therefore an increase of the electromagnetic braking force. In this respect this way of carrying out the invention appears advantageous. However, as is known, in this case the peripheral skin of the metal which is already solidified constitutes a magnetic shield which is the greater, the greater the speed of rotation of the magnetic field is. It will therefore be understood that in certain cases the superposition of the two opposite effects will result in an overall weakening of the action of the electromagnetic force.

It is therefore possible to sum up the various possibilities of action of the magnetic field in the table below:

| Arrangement | | |
|---|---|---|
| Direction | Moving | Stationary |
| Normal to the axis of the casting | turning about the axis of the casting [1] | alternative or continuous [2] |
| parallel to the axis of the casting | sliding along the axis of the casting [3] | alternative or continuous [4] |

In this table the numbers between brackets are indicative of the correspondent arrangement which are used for carrying out the method.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
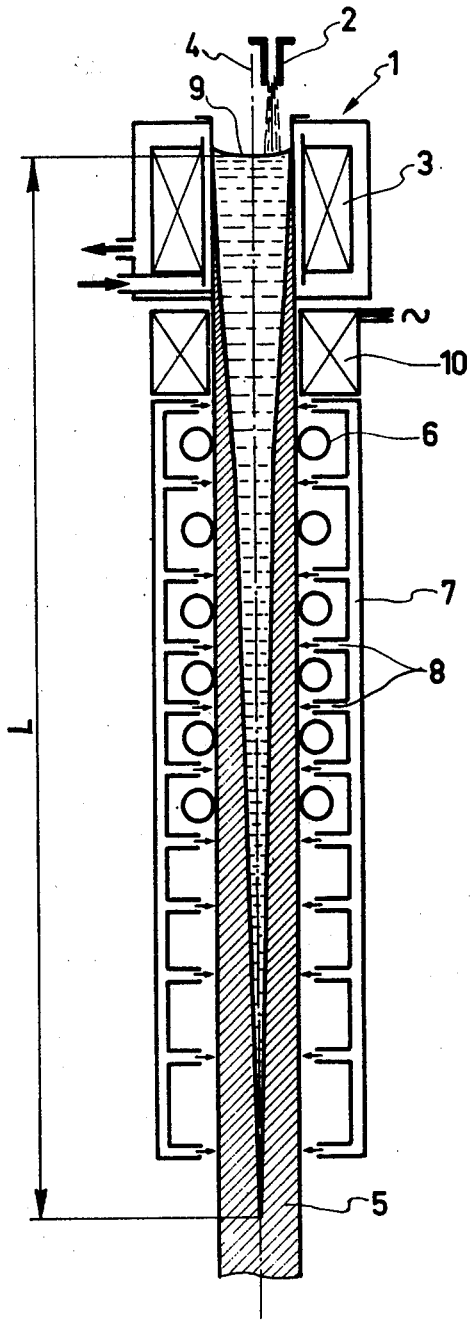
FIG. 1 schematically illustrates in a longitudinal cross-section a simplified view of an installation for continuous centrifugal casting by electromagnetic means according to the present invention.

FIG. 1 schematically illustrates an installation for continuous casting of billets in vertical direction which comprises a vertical ingot mold 1 into which liquid metal is continuously fed from a nozzle 2 mounted at the bottom of a distributor, not shown in the drawing. The ingot mold is provided with an electromagnetic inductor 3 producing a magnetic field traversing the liquid metal in a direction normal to the axis 4 of the casting and rotating about this axis. This inductor may for instance correspond to an inductor described in the French Pat. No. 2,315,544 and the corresponding U.S. Pat. No. 4,026,346. The liquid metal in the ingot mold 1 is thus caused to rotate about the axis of the latter, which rotation increases progressively towards the bottom of the ingot mold during continuous withdrawing of the billet 5 from the latter. The billet 5 during its solidification is supported below the ingot mold by support rollers 6 at least one of which may be driven to continuously withdraw the billet 5 from the ingot mold 1. The billet 5 is cooled downstream of the ingot mold by water jets emanating from a wetting arrangement 7 provided with cooling nozzles 8. The billet is solidified throughout its cross-section at a distance L from the liquid meniscus 9 in the ingot mold, which distance is generally called "metallurgic length". The liquid metal forms throughout its length a central well in form of an elongated cone. It is to be understood that the liquid well is represented in FIG. 1 by way of example, without assuming to correspond to the actual consisting configuration along the metallurgic length and with respect to the dimensions of the cast billet. According to one embodiment of the present invention a second electromagnetic inductor, schematically illustrated at 10, is arranged about the cast product beneath the ingot mold 1 and upstream of the cooling arrangement 7. This inductor 10 may be of a known type and certain specific constructions will be described in connection with the following Figures.

Figure 2:
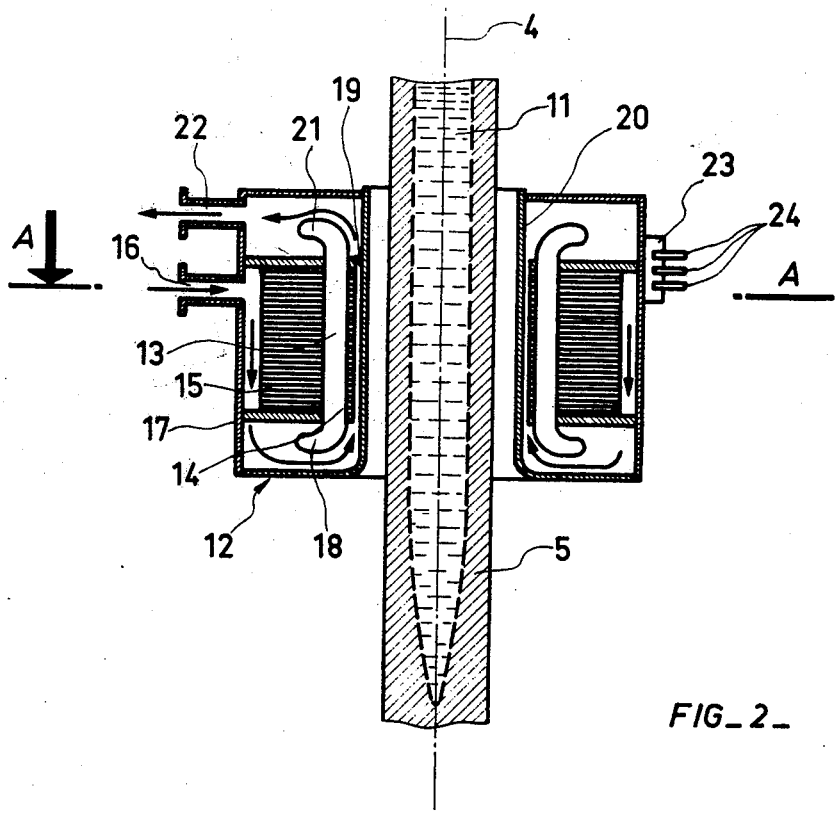
FIG. 2 is a longitudinal cross-section through an arrangement creating a magnetic field normal to the axis of the casting and turning about this axis.
Figure 3:
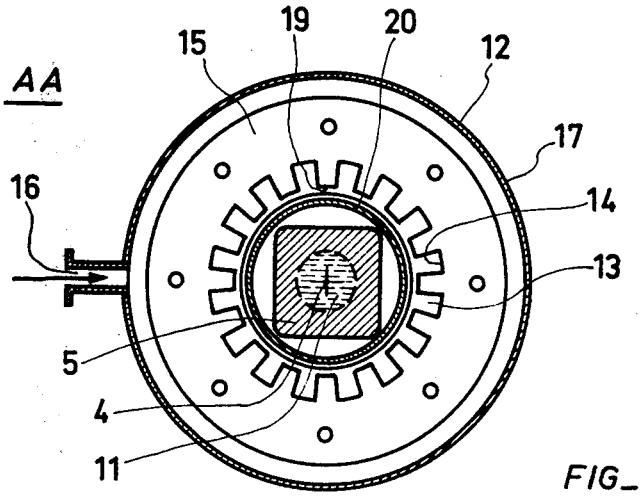
FIG. 3 is a cross-section taken along the line II—II of FIG. 2.

FIGS. 2 and 3 illustrate an electromagnetic inductor suitable for carrying out the invention according to a modification which is employed for putting the invention into practice and which is referred to in the preceding table with the numeral [1]. The electromagnetic inductor is constructed to create a magnetic field which traverses the billet 5 in a direction normal to the axis of the casting 4 and turning about the axis in a direction opposite to the direction of rotation of the liquid metal 11 imparted thereto in the preceding ingot mold. This inductor is known per se and its detailed description may be found in the French Pat. No. 2,211,305. It is, however, pointed out that the inductor is placed in an annular casing 12 which surrounds the casting and which is internally cooled by circulating water. The inductor itself is constituted by a winding 13 arranged in longitudinally extending slots 14 of a stack of magnetic sheets 15. The cooling water is fed into the casing 12 by an inlet conduit 16 and flows from there downwardly between the outer periphery of the stack of sheets 15 and the outer wall 17 of the casing 12, then in horizontal direction at the bottom of the casing, cooling thereby the bottom ends of the winding and the cooling water flows subsequently thereto in upward direction through the notches 14 and the annular space 19 between the inner peripheral surface of the stack of sheets 15 and the internal wall 20 of the casing to finally flow again in horizontal direction at the upper end of the casing, cooling thereby the upper heads 21 of the winding, to be discharged through the discharge conduit 22. FIG. 2 also shows an electrical connection box 23 connecting the inductor to the lines of a three-phase network 24.

Figure 5:
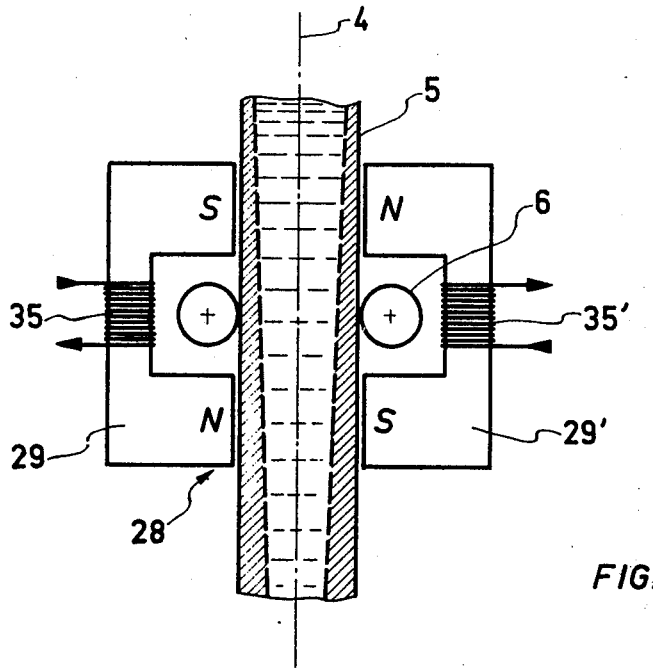
FIG. 5 is a longitudinal cross-section through a modification of an arrangement creating a stationary magnetic field normal to the axis of the casting.
Figure 4:
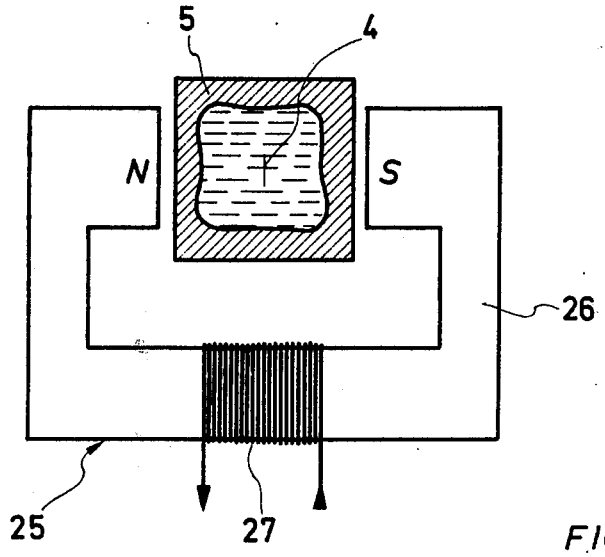
FIG. 4 is a schematic transverse cross-section of an arrangement creating a stationary magnetic field normal to the axis of the casting.

The arrangements respectively illustrated in FIGS. 4 and 5 are both suitable to carry out the invention according to the variation referred with the numeral [2] of the preceding table. As shown in FIG. 4, the electromagnetic inductor utilizes a very simple concept. It is constituted by an electromagnet 25 comprising a magnetic core 26 of U-shape and arranged transverse to the axis of the casting 4 and a spool 27 surrounding the base of the U-shaped core and connected to a non-illustrated electric supply. The cast product 5 is arranged in the air gap of the electromagnet in such a manner to close the magnetic circuit.

FIG. 5 illustrates another embodiment of an inductor according to the present invention, which may be preferred to the preceding one, especially with respect to the necessary space requirements. As shown in FIG. 5, the inductor 28 is composed of two identical electromagnets 29 and 29' respectively disposed to opposite sides of the cast product 5. Each of the electromagnets is constructed similar to that illustrated in FIG. 4 and each has a U-shaped magnetic core which is however longitudinally oriented. As can be seen from FIG. 5, such an arrangement permits to obtain between the branches of the U-shaped cores a sufficient space for the installation of support rollers 6. The action of the magnetic field is largest between the poles of the magnets, which are arranged opposite each other with different polarities as indicated in FIG. 5.

Figure 6:
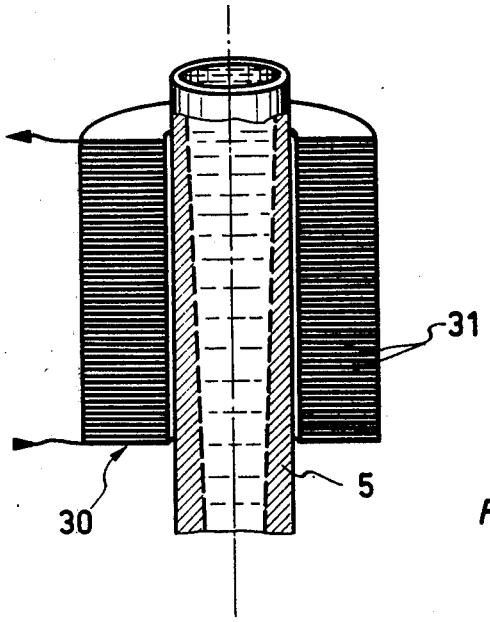
FIG. 6 is a schematic longitudinal cross-section of an arrangement creating a stationary magnetic field extending in the direction of the axis of the casting.

The inductor illustrated in FIG. 6 is used to carry out the invention according to the variation represented by the numeral [4] of the preceding table. The electromagnetic inductor 30 is constituted by a flat conductor 31 wound about the casting 5 in the manner of a solenoid. The cables for supplying the solenoid with electric current are schematically illustrated in FIG. 6 by the arrows respectively disposed at the lower and upper ends of the inductor.

Figure 7:
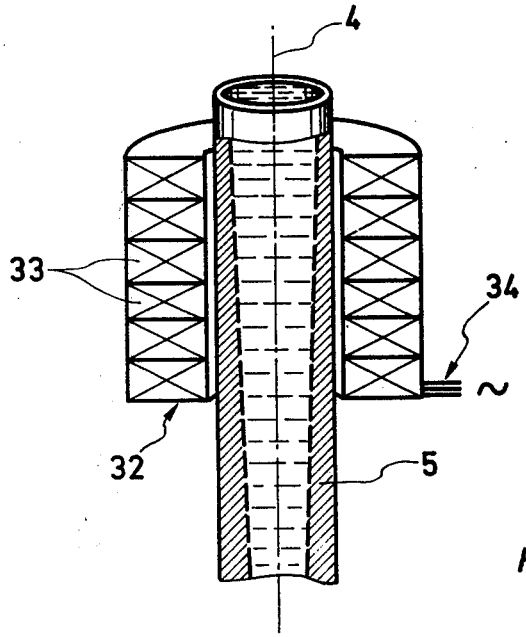
FIG. 7 is a schematic longitudinal cross-section through an arrangement creating a magnetic field extending in the direction of the axis and sliding along this axis.

FIG. 7 illustrates an electromagnetic arrangement for carrying out the present invention in conformity with the variation designated with the numeral [3] of the preceding table. This electromagnetic arrangement is similar to that utilized in an ingot mold for continuous casting and described in the French patent of the inventor Pat. No. 2,248,103 and the U.S. Pat. No. 3,941,183. It is mentioned that the electromagnetic inductor 32 illustrated in FIG. 7 is of tubular structure arranged about the cast product 5. This inductor 32 is similar to a stator of a linear motor and comprising six superimposed spools 33. Each spool is formed by conductive windings wound about the axis 4 of the casting. The spools are connected to a three-phase electrical supply by means of a connecting box schematically shown at 34. The inductor is divided into three groups of two spools connected to each other in opposition and each group being connected to one phase of the electric supply in such a manner to create in the air gap of the inductor a magnetic field propagating in the direction of the axis of the casting. The propagation of the waves of the electromagnetic field in upward or downward direction may be obtained simply by inversion of the order of the phases of the electric supply. The inventors prefer the second possibility, that is a descendent movement of the waves of the electromagnetic field since in addition to the braking action on the rotation of the liquid metal about the axis 4, the sliding magnetic field acts also in the zone adjacent to the inner surface of the solidified skin in such a manner to impart to the liquid metal in the zone a descendent movement. In this way a permanent circulating current is created in the volume of the liquid metal under the action of the magnetic field in which the metal descends in the peripheral zone and rises again in the axial zone. In this way, the non-metallic inclusions which have a tendency to concentrate in the center of the product are dispersed through the whole volume of the available liquid metal. It is further known that the effect of the shearing action caused by such movement at the neighborhood of the inner surface of the solidified skin prevents also the formation of a zone of solidification of the basaltic type. It is this type of inductor which imparts to the process according to the present invention the greatest flexibility. As far as the regulation of the electromagnetic parameters is concerned, it should be noted that the dispersion of the non-metallic inclusions will be the more effective, the greater the intensity of the magnetic field is, which can be ascertained by the following equation:

$$B^2 = \frac{\rho \times \ln[(Vi - k)/(Vf - k)]}{\gamma \times \Delta T}$$

wherein

B is the intensity of the magnetic induction in Tesla, $\rho$ is the volumetric mass of the liquid steel at the temperature under consideration (for instance in the neighborhood of 7000 kilogram per $m^3$), $\gamma$ is the electric conductivity of the liquid steel in Siemens per meter (in the neighborhood of $6.25 \times 10^5$s/m), Vi and Vf represent the speed of rotation of the liquid metal respectively at the moment of its entrance in and its exit from the action of the inductor, (revolutions per second), k represents the speed of rotation of the magnetic field (revolutions per second), (these speeds are positively counted in the sense of rotation of the metal), and $\Delta T$ represents the time in seconds the liquid steel resides in the zone of action of the inductor. $\Delta T$ can be easily calculated by knowing the length of the used inductor and the speed of extraction of the cast product.

Two cases have to be considered. The magnetic field may be stationary (continuous or alternating) or moving in a direction normal to the direction of the rotational movement which pre-exists in the liquid metal (magnetic field sliding along the axis of the casting). In this case k is equal to zero and it will immediately be seen that the antagonistic electromagnetic action cannot by itself completely suppress the residual rotation of the liquid metal (Vf=0), except if the intensity of the magnetic field or the time the liquid metal remains in the zone of action of the inductor are very great, which, in the two cases cannot be practically realized. Tests taken by the inventors have shown that a satisfactory dispersion of the non-metallic inclusions can be obtained when the residual rotation of the liquid metal is brought to a value not surpassing about 30 revolutions per minute. On the other hand, if the magnetic field rotates about the axis of the casting, the superposition of the real speed of rotation of the liquid metal and the speed of rotation of the rotating field itself has to be taken into consideration. If, as recommended by the inventors, the rotation of the magnetic field is chosen in a direction opposite to the rotational movement of the liquid metal, the respective modules of the speeds of the field and that of the metal are added to each other.

Two nominal examples of carrying out the method according to the present invention respectively corresponding to a stationary magnetic field and to a rotating magnetic field are given by way of example. The speed of extraction of the cooled billet is in the order of 4 meters per minute. The length of the zone of action of the inductor is in the neighborhood of 50 centimeters, which corresponds to the height of an inductor generally used in a process of electromagnetic mixing in the secondary cooling zone of an apparatus for continuous casting of metal. In this way a residence time of the liquid metal in the zone of action of the inductor is about 7.5 seconds. On the other hand, the initial rotation imparted to the liquid steel is in the order of 120 revolutions per minute, that is 2 revolutions per second.

By application of the equation set forth above, it will be noted that in the case of a stationary field a magnetic induction B in the neighborhood of 500 Gauss will be necessary.

By using a magnetic field which turns in a direction opposite to the direction of rotation originally imparted to the liquid metal, with for example a speed of rotation of the inverse magnetic field of 50 revolutions per second, only a magnetic induction in the order of 70 Gauss will be necessary. This value corresponds to the intensity of the field in the liquid metal. As mentioned before this magnetic field is reduced by traversing the solidified metallic skin of the casting. At the considered speed of rotation, that is 50 revolutions per second, one can estimate that this reduction of the magnetic induction is in the neighborhood of 30%. From this results that the magnetic induction to be produced at the level of the poles of the inductor should be in the order of 100 Gauss. It will thus be seen that an advantage of carrying out the present invention with a rotating electromagnetic field resides in the possibility to use a magnetic field of an intensity which is considerably smaller than in the case of a fixed magnetic field. Another advantage resides in the fact that it is also possible to completely suppress the residual rotation of the liquid metal (Vf=0).

What is set forth below concerns the intensity of the action of the electromagnetic field in relation to the duration of this action on the liquid metal.

It is clear that the dispersion of the non-metallic inclusion in the products cast will be the more effective, the sooner the electromagnetic antagonistic action takes place, that is as close as possible to the ingot mold, because, as already stated, the volume of the available liquid metal for the dispersion of the inclusions will be at its maximum at this location.

However, as likewise set forth above, it is known that an essential result of continuous centrifugal casting, or more generally of all methods of continuous casting with a mixing of the cast product, resides in the suppression of a basaltic zone of solidification, in the central portion of the casting and by its replacement by a zone of solidification of the coaxial type. It is generally considered that the forced movement of convection imparted to the liquid metal play a decisive role among the factors responsible for such a result. In this respect it seems therefore desirable to maintain the liquid metal in rotation as long as possible.

From this results an incompatibility between two distinct metallurgical objectives, that is, on the one hand, the uniform distribution of the non-metallic inclusions and, on the other hand, the structure of solidification of the cast product and consequently a certain ambiguity as to the optimum location of the action of the magnetic field. Nevertheless these incompatabilities are only apparent since the work carried out by the inventors has shown that, with the exception of some special cases, once the basaltic zone is interrupted for the benefit of a coaxial solidification, formation of a new basaltic zone will not take place any longer and that independent of the movements of convention imparted to the liquid metal.

It will, therefore, be understood that an advantageous solution consists to localize the action of the magnetic field at a place along the metallurgic length which corresponds to a zone in which the axial solidification has already begun. This solution presents, however, the difficulty to detect at which level of the metallurgic length the basaltic zone is interrupted to the benefit of the coaxial zone, a detection which is especially difficult since this level is liable to fluctuate during the same casting process with the inevitable variation of certain parameters, such as the speed of casting, or the initial heating of the metal, or from one casting to another as a function of the form of the cast product. Another more satisfactory solution consists to replace the movement of rotation of the metal about the axis of the casting by a circulating movement along the axis of the casting, for example by utilizing an inductor producing a sliding magnetic field such as represented by the FIG. 7. Thus this modification permits, during the solidification process the formation of a large equiaxial zone.

It will be understood that the last-mentioned solution has the advantage of permitting freedom of choice of the location of the action of the magnetic field along the metallurgic length, and especially to locate the action the magnetic field immediately beneath the ingot mold, that is at a place where the volume of the available liquid metal is the greatest.

It will be understood that each of the elements described above, or two or more together, may also find a useful application in other types of continuous centrifugal casting of metal, differing from the types described above.

While the invention has been illustrated and described as embodied in a method and an apparatus for continuous centrifugal casting of metal, it is not intended to be limited to the details shown, since various modifications and structural changes may be made without departing in any way from the spirit of the present invention.

Thus, the method according to the present invention may be used on all known and future installation of continuous centrifugal casting of metal in which the metal is rotated by mechanical or electromagnetic means, and for the casting of billets of circular square, rectangular or other cross-section.

Nevertheless, if the present invention is carried out in an arrangement in which rotation of the liquid metal is carried out by mechanical means, it is preferably not to localize the action of the inductor for braking the rotation too far below the secondary zone of cooling, since otherwise there exists the risk to act on a metallic mass which during its solidification is already rather viscous, that is, having a consistency which would render it integral with the outer already solidified skin despite the action of the magnetic field.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of continuous centrifugal casting of metal products comprising the steps of continuously passing liquid metal through an elongated cooled ingot mold having a longitudinal axis so that the metal is partly solidified as it leaves the ingot mold; rotating the liquid metal during such passing through the mold about said axis; subjecting the partly solidified casting as it leaves the ingot mold to electromagnetic forces counteracting the rotation of the still liquid metal core in the interior of the casting; and continuously withdrawing the casting in a predetermined direction.

2. A method as defined in claim 1, wherein said counteracting forces are produced by a magnetic field which traverses the partly cooled casting in a direction having a component which includes in a radial plane including the axis of the casting an angle greater than zero with said axis.

3. A method as defined in claim 1, wherein said counteracting forces are produced by a magnetic field which traverses the partly cooled casting in a direction normal to the axis of the casting.

4. A method as defined in claim 1, wherein said counteracting forces are produced by a magnetic field which traverses the partly cooled casting in a direction parallel to said axis of the casting.

5. A method as defined in claim 2, wherein the magnetic field is stationary.

6. A method as defined in claim 3, wherein said magnetic field is a field rotating about the partly cooled product in a direction opposite to the direction of rotation of the still liquid metal core thereof.

7. A method as defined in claim 4, wherein said magnetic field is a mobile field moving in the direction of the axis of the casting.

8. A method as defined in claim 7, wherein said magnetic field is moving in said predetermined direction of withdrawing the casting.

9. A method as defined in claim 2, wherein said counteracting forces are arranged to act on said partly cooled casting after the begin of formation of an equiaxial structure of solidification.

10. In an apparatus for continuous centrifugal casting of metal, a combination comprising an elongated cooled ingot mold having an axis; means for continuously feeding molten metal into said ingot mold; means for rotating the liquid metal in said ingot mold about said axis; and means arranged downstream of said ingot mold for subjecting the still liquid core of the partly solidified casting leaving the ingot mold to electromagnetic forces opposing rotation of the still liquid metal core.

11. A combination as defined in claim 10, wherein said rotation opposing means comprise at least one electromagnet forming an air gap through which the partly solidified casting passes and producing a stationary magnetic field normal to the axis of the casting.

12. A combination as defined in claim 10, wherein said rotation opposing means comprise stationary tubular inductor means surrounding the casting and means supplying said conductor means with a multiphase electric current for producing a magnetic field normal to the axis of the casting and rotating about said axis.

13. A combination as defined in claim 10, wherein said rotation opposing means comprises a solenoid surrounding the casting.

14. A combination as defined in claim 10, wherein said rotation opposing means comprises a stationary tubular inductor means surrounding the casting and composed of a stack of coaxial coils and means for connecting said coils to a multiphase net for producing a magnetic field moving in the direction of the axis of the casting.

15. A metal casting produced according to the method of claim 1.

* * * * *